US010569838B2

(12) United States Patent
Taylor et al.

(10) Patent No.: US 10,569,838 B2
(45) Date of Patent: Feb. 25, 2020

(54) CHAIN STOPPER

(71) Applicant: Flintstone Technology Limited, Dundee (GB)

(72) Inventors: Richard Taylor, Kendal (GB); Andrew Clayson, Dundee (GB); David Smith, Dundee (GB)

(73) Assignee: Flintstone Technology Limited, Dundee (GB)

( * ) Notice: Subject to any disclaimer, the term of this patent is extended or adjusted under 35 U.S.C. 154(b) by 0 days.

(21) Appl. No.: 16/076,839

(22) PCT Filed: Feb. 10, 2017

(86) PCT No.: PCT/GB2017/050368
§ 371 (c)(1),
(2) Date: Aug. 9, 2018

(87) PCT Pub. No.: WO2017/137775
PCT Pub. Date: Aug. 17, 2017

(65) Prior Publication Data

US 2019/0047664 A1 Feb. 14, 2019

(30) Foreign Application Priority Data

Feb. 10, 2016 (GB) ..... 1602400.2

(51) Int. Cl.
*B63B 21/18* (2006.01)
*B63B 21/10* (2006.01)
*B63B 21/50* (2006.01)

(52) U.S. Cl.
CPC ..... *B63B 21/18* (2013.01); *B63B 21/10* (2013.01); *B63B 21/50* (2013.01)

(58) Field of Classification Search
CPC ..... B63B 21/00; B63B 21/04; B63B 21/10; B63B 21/18; B63B 21/50
(Continued)

(56) References Cited

U.S. PATENT DOCUMENTS 4,958,805 A 9/1990 Willamsson
5,845,893 A 12/1998 Groves
(Continued)

FOREIGN PATENT DOCUMENTS

EP 1 318 072 A2 6/2003
JP 62-241788 A 10/1987
(Continued)

OTHER PUBLICATIONS

International Search Report and Written Opinion of the International Searching Authority, International Application No. PCT/GB2017/050368, dated May 24, 2017, 9 pp.

*Primary Examiner* — Lars A Olson
(74) *Attorney, Agent, or Firm* — Myers Bigel, P.A.

(57) ABSTRACT

A device for connecting a chain or line, such as a portion of a chain or line, to a structure, the device comprising a first portion comprising a first axis, the first portion being configured to connect or be connectable to a structure so as to be movable relative to the structure; a first guide element, the first guide element being arranged on or relative to the first portion to be movable around or about the first axis of the first portion; and a second guide element, the second guide element being configured to align at least a portion of a chain relative to the first guide element.

19 Claims, 6 Drawing Sheets

(58) Field of Classification Search
USPC ..... 114/200
See application file for complete search history.

(56) References Cited

U.S. PATENT DOCUMENTS

| | | | | |
|---|---|---|---|---|
| 7,926,436 | B2 | 4/2011 | Boatman et al. | |
| 10,029,763 | B2 * | 7/2018 | Taylor | B63B 21/50 |
| 2005/0241558 | A1 | 11/2005 | Barlow | |
| 2012/0160146 | A1 | 6/2012 | Miller et al. | |

FOREIGN PATENT DOCUMENTS

| | | | |
|---|---|---|---|
| WO | WO 2005/105563 | A1 | 11/2005 |
| WO | WO 2010/085156 | A1 | 7/2010 |
| WO | WO 2015/150770 | A1 | 10/2015 |

* cited by examiner

CHAIN STOPPER

RELATED APPLICATIONS

This application is a 35 U.S.C. § 371 national stage application of PCT Application No. PCT/GB2017/050368, filed on Feb. 10, 2017, which claims priority from Great Britain Patent Application No. 1602400.2, filed on Feb. 10, 2016, the contents of which are incorporated herein by reference in their entireties. The above-referenced PCT International Application was published in the English language as International Publication No. WO2017/137775 A1 on Aug. 17, 2017.

FIELD OF INVENTION

This invention relates to a device for connecting a chain to a structure and associated methods and assembly. The device may be a so-called "chain stopper." The device may find utility in or on a structure, such as a marine structure, offshore structure, subsea structure, floating structure, floating platform, buoy or vessel.

BACKGROUND TO INVENTION

Chain stopper devices can provide an attachment or connection of a chain to, for example, a vessel. A part of the chain may be moored to a seabed. By adjustment of the chain length or tension of the chain connected to the vessel, a position of the vessel can be altered or controlled.

WO 2015/150770 in the name of the present Applicant discloses an example of a chain stopper. In use, movement of the vessel can change the alignment of the chain relative to the chain stopper. The chain may extend at an angle, e.g. an azimuthal angle, relative to part(s) of the chain stopper. When this angle becomes large, the chain may become misaligned relative to part(s) of the chain stopper and/or the vessel. This can lead to the chain riding over part(s) of the chain stopper, which may lead to damage of the chain stopper and the chain, for example, when tension is applied to the chain to adjust the length of the chain or alter the position of the vessel.

By increasing the size of the chain stopper or parts thereof, the risk of misalignment between the chain and the chain stopper may be reduced. However, this may lead to an increased weight of the device and larger amounts of material needed to manufacture the chain stopper, which may lead to higher production costs.

It is an object of at least one embodiment of at least one aspect of the present invention to seek to obviate or at least mitigate one or more of the afore mentioned problems.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF INVENTION

According to a first aspect of the present invention there is provided a device for connecting a chain or line, e.g. at least one portion of a chain or line, to a structure. The device may be or comprise a marine, offshore and/or underwater device. The device may be or comprise a chain stopper or connector.

In some examples, the device may comprise or be provided with a fairlead. For example, the device may comprise or be a chain stopper comprising the fairlead or may be provided with or in combination with the fairlead.

The device may comprise a first portion.

The device may comprise a first axis, e.g. a first transverse and/or rotational axis. The first axis may be part of or comprised in the first portion. The first portion may be configured to connect or be connectable to a structure, e.g. so as to be movable relative to the structure. The first portion may be configured to connect or be connectable to a structure, e.g. so as to be rotatable or pivotable relative to a structure, e.g. around or about the first axis of the first portion. The first portion may be or define at least a part of the fairlead.

The device may comprise a first guide element or first guide means. The first guide element may be arranged on or relative to the first portion to be movable, e.g. rotatable or pivotable, around or about the first axis of the first portion. The first guide element and/or the first portion may be coaxially arranged. The first guide element may be configured to guide a chain, e.g. at least a portion of a chain, around or about the first axis. The provision of the first guide element may facilitate tensioning, e.g. pulling or pulling-in, of at least a portion of a chain and/or adjusting a length of a chain. The first guide element may be, comprise or define at least another part of the fairlead. For example, the first guide element may be or comprise a guide wheel, fairlead wheel, sheave, pulley wheel, cog wheel or the like. The device may comprise a second guide element or second guide means. The second guide element may be configured to align a chain, e.g. at least a portion of a chain, relative to the first guide element. The second guide element may be configured to align a chain, e.g. at least a portion of a chain, relative to the first guide element irrespectively and/or independently of an angle, e.g. an azimuthal angle, at which a chain extends, e.g. towards a seabed, relative to the device, e.g. the first portion and/or the first guide element. By providing the device with a second guide element, misalignment of a chain relative to the first guide element and/or a structure may be reduced and/or prevented.

The device may comprise at least part of a connection arrangement for connecting, e.g. releasably connecting, the device to a structure. The at least part of the connection arrangement may comprise a first elongate member. The first elongate member may define or comprise the first axis.

The second guide element may be arranged in proximity to the first guide element. For example, the second guide element may be arranged or provided on the first portion, e.g. on an end of the first portion proximal to the first guide element.

The second guide element may be configured to guide and/or align a chain or line, e.g. at least a portion of a chain or line, relative to a central or longitudinal axis of the first guide element and/or device. For example, the second guide element may be configured to guide, move and/or bring a chain or line, e.g. at least a portion of a chain or line, into axial alignment with the longitudinal or central axis of the first guide element and/or device. In other words, the second guide element may be configured to guide a chain or line, e.g. at least a portion of a chain or line, such that a longitudinal axis of a chain or line, e.g. a portion of a chain or line, may be substantially aligned or coincident with the longitudinal axis of the first guide element and/or device.

The second guide element may be configured to substantially align a chain or line, e.g. a longitudinal axis of at least a portion of a chain or line, with a tangential portion of the first guide element. The tangential portion of the first guide element may be or comprise a portion and/or axis of the first guide element that extends tangentially from the first guide element.

The second guide element may be configured to guide a chain or line, e.g. at least a portion of a chain or line, towards the first guide element.

In some examples, the second guide element may be configured to align a chain or line, e.g. at least a portion of a chain or line, relative to the first guide element prior to engagement of that portion of a chain or line with the first guide element. The second guide element may be configured to maintain alignment of a chain or line, e.g. at least a portion of a chain or line, relative to first guide element, e.g. in use.

In some examples, the second guide element may comprise or define a shape or profile. The shape or profile may be configured to be compatible and/or complementary with a shape of a chain. For example, a chain may comprise a plurality of chain links. The chain links may alternatively extend in a first direction and a second direction. The first and second directions may be substantially perpendicular to each other. The second guide element may be configured to guide and/or align a chain, e.g. the/each chain link of the plurality of chain links.

In some examples, the second guide element may define or comprise a passage. A chain or line may be passable, runnable, threadable, passed, run or threaded through the passage, e.g. in use. The passage may be configured to co-operate or engage with a chain, e.g. to align a chain or line, e.g. at least a portion of a chain or line, relative to the central or longitudinal axis of the first guide element and/or device. The passage may be configured to co-operate with a chain or line, e.g. at least a portion of a chain or line, to guide a chain towards the first guide element. For example, the passage may comprise or define a cross-section adapted or configured to substantially match or correspond to at least part of a cross-section of a chain.

In some examples, the passage may comprise a first opening and/or a second opening. The first and second openings of the passage may be provided at either end of the passage. The passage may be configured to taper from the first and second openings of the passage towards an inner part of the passage. By configuring the passage to taper towards an inner part of the passage, entry of a chain or line into the second guide element, e.g. the passage, may be facilitated.

In some examples, the passage may comprise or define at least a first passage portion. The first passage portion may extend in a first direction of the second guide element. The passage may define or comprise a second passage portion. The second passage portion may extend in a second direction of the guide element. The first and/or second directions may be substantially perpendicular to the a/the longitudinal axis of the second guide element and/or device. The first and second passage portions may be arranged relative to each other such that the first and second directions are substantially perpendicular to each other. The first passage portion may be configured to guide and/or align chain links of a chain, which extend in the first direction. The second passage portion may be configured to guide and/or align chain links of a chain, which extend in the second direction.

In some examples, at least one of the first and second passage portions may comprise or define an aperture or slot. The aperture or slot may be configured to guide and/or align chain links of a chain, which extend in one of the first and second directions. The aperture or slot may be arranged on the second guide element to extend along or in a substantially longitudinal direction of the second guide element.

In some examples, the device may comprise a second portion. The second portion may be configured to connect or be connectable to the first portion, e.g. so as to be movable relative to the first portion. The second portion may be configured to connect or be connectable to the first portion, e.g. so as to be rotatable or pivotable relative to the first portion.

In some examples, the second guide element may be arranged on the second portion. The second guide element may be arranged on the second portion instead of being arranged on the first portion. Alternatively the second guide element may be arranged on the second portion in addition to being arranged on the first portion. For example, the second guide element may comprise a first guide portion and a second guide portion. The first guide portion may be arranged on the first portion of the device and the second guide portion may be arranged on the second portion of the device.

In some examples, the second guide element may be arranged on an underside of at least one of the first portion and the second portion.

In some examples, the device may comprise a further passage, e.g. for receiving at least a portion of a chain or line. The further passage may be part of, defined by or comprised in the second portion. For example, in use, a chain may be threadable, passable or runable run, threaded and/or passed through the further passage of the second portion. The further passage may comprise a first opening and/or a second opening. The first opening of the further passage may be arranged on a first end region or portion of the second portion. The first end region or portion of the second portion may be proximal to the first portion, e.g. when the second portion is connected to the first portion. The second opening of the further passage may be arranged on a second end region or portion of the second portion. The second end region of portion of the second portion may be distal to the first portion, e.g. when the second portion is connected to the first portion. The first opening of the further passage may be arranged or configured to receive and/or provide an exit for at least a portion of a chain that is proximal to the structure, e.g. in use. The second opening may be arranged or configured to receive and/or provide an exit for at least a portion of a chain that is distal to a structure, e.g. a portion that extends towards a seabed.

In some examples, the second guide element may be arranged at or on the first end region or portion of the second portion. The second guide element may be arranged in proximity or at the first opening of the further passage. The second guide element may be arranged and/or configured to retain a portion of a chain that exits, enters and/or extends from the second portion towards a structure, e.g. a portion of a chain that is proximal to a structure, e.g. in use. By arranging the second guide element at or on the first end region or portion of the second portion, the second guide element may retain a portion of a chain that may be slack, e.g. in use, when no tension is applied to a portion of a chain that is proximal to a structure. For example, a portion of a chain that is proximal to a structure, e.g. in use, may be slack or less tension.

The device may comprise a second axis, e.g. a second transverse and/or rotational axis. The second axis may be part of or comprised in the second portion. The second portion may be connected or be connectable to the first portion so as to be movable, e.g. rotatable or pivotable, relative to the first portion, e.g. around or about the second axis of the second portion. The second axis may be arranged to be substantially perpendicular to the first axis, e.g. when the first and second portions are connected to each other.

The device may comprise a second elongate member. The second elongate member may connect second portion to the first portion of the device. The second elongate member may define or comprise the second axis of the device, e.g. second portion.

In some examples, the device may comprise a chain engaging arrangement. The engaging arrangement may be connectable or connected to the first and/or second portion, e.g. so as to be movable relative to the first and/or second portion. The chain engaging arrangement may be configured to allow movement of a chain relative to the device in a first direction. For example, movement of a chain in the first direction may comprise movement of a chain towards a structure. The chain engaging arrangement may be configured to inhibit movement of a chain in a second direction relative to the device. For example, movement of a chain in the second direction may comprise movement of a chain towards a seabed.

The chain engaging arrangement may comprise an engaged and/or a disengaged or non-engaging configuration or position. In the engaged configuration, the chain engaging arrangement may inhibit or prevent movement of a chain relative to the device in the second direction, e.g. towards a seabed. For example, in the engaged configuration the chain engaging arrangement may restrain, prevent and/or lock movement of a chain in the second direction relative to the first portion, second portion and/or device.

In the disengaged or non-engaging configuration, the chain engaging arrangement may allow movement of a chain in one or more directions. For example, in the disengaged or non-engaging configuration movement of a chain may be permitted to move in the first and/or second direction(s) (e.g. towards a structure and/or seabed).

The chain engaging arrangement may be operable, switchable or actuatable between the engaged and/or the disengaged or non-engaging configuration or position. For example, in use, when tension is applied to a chain, e.g. a portion of a chain that is proximal to a structure, the chain engaging arrangement may be operated, switched or actuated from the engaged configuration to the disengaged or non-engaging configuration. This may allow movement of a chain relative to the device in the first direction. When no tension is applied to a portion of a chain that is proximal to a structure and/or tension is reduced, e.g. in use, the chain engaging means may move into the engaging configuration. This may prevent movement of a chain or line, e.g. at least a portion of a chain or line, towards as seabed subsequent to adjustment of the tension of a chain and/or a length of a chain.

In some examples, the chain engaging arrangement may comprise a first configuration and a second configuration. The chain engaging means may be operable, switchable, actuatable and/or movable between the first configuration and the second configuration. For example, the chain engaging arrangement may be operable, switchable, actuatable and/or movable between the first and second configuration by applying tension to a portion of a chain that is proximal to a structure, e.g. in use. The chain engaging arrangement may be in the first configuration, e.g. when no tension is applied to the proximal portion of a chain, e.g. in use. The chain engaging arrangement may switch to and/or move into the second configuration, e.g. when tension is applied to a proximal portion of a chain, e.g. in use. In the second configuration of the chain engaging arrangement, the chain engaging arrangement may be configured to align a portion of a chain that is distal to a structure, e.g. a portion of a chain extending towards a seabed, so as to be in line or coaxial with the longitudinal or central axis of the device, e.g. in use. By aligning a portion of a chain that is distal to a structure to be in line or coaxial with the longitudinal or central axis of the device, out of plane bending of a chain and/or device and/or out of plane strain of a chain and/or the device may be prevented or reduced. Such coaxial arrangement may allow the use of higher forces during tensioning, e.g. pulling-in, of a chain.

In some examples, the device may comprise a third guide element. The third guide element may be part of or comprised in the chain engaging arrangement. The third guide element may be configured to guide a chain to or into the chain engaging arrangement. The third guide element may be configured to align a chain relative to the chain engaging arrangement. The third guide element may be configured to align or orient a chain relative to the chain engaging arrangement and/or the device.

The device may comprise a first connection element. The first connection element may be part of or comprised in the part of the connection arrangement for connecting the device to a structure.

The first connection element may be configured to connect the device to a structure, e.g. so as to be movable, e.g. pivotal or rotatable, relative to a structure. The first connection element may be configured to co-operate and/or engage with a second connection element of a structure. The first connection element may be arranged on or relative to the first elongate member of the device, e.g. to permit pivotal or rotational movement of the device relative to a structure. The first connection element may be configured to connect, secure, and/or lock, e.g. releasably connect, secure, and/or lock, the device to a structure. The first connection element may be configured to connect, attach or secure the first elongate member of the device to a structure, e.g. so as to permit rotational or pivotal movement of the device relative to a structure.

In some examples, the device may comprise a pair of first connection element for connection to a pair of second connection elements of a structure. The/each first connection element may be arranged on or relative to the first elongate member. The/each first connection element may be arranged on either side of the first guide element.

According to a second aspect of the present invention is provided an assembly. The assembly may be suitable for or configured to connect a chain or line, e.g. at least a portion of a chain or line, to a structure.

The assembly may comprise a device for connecting a chain or line, e.g. at least a portion of a chain or line, to a structure. The device may comprise any of the features of the device according to the first aspect.

The assembly may comprise a structure. The structure may be or comprise an offshore structure, marine structure, subsea structure, floating structure, floating platform, buoy and/or vessel.

The device may be connected or connectable to the structure, e.g. in use. The device may be connected or connectable to the structure so as to be movable, e.g. pivotable or rotatable, relative to the structure.

The assembly may comprise a/the connection arrangement. The connection arrangement may be configured to connect, e.g. releasably connect, the device to the structure.

At least a part of the connection arrangement may be part of or comprised in the device. At least one other part of the connection arrangement may be part of or comprised in the structure.

The connection arrangement may comprise the first and/or second connection element(s). The connection arrangement may comprise a plurality of first and/or second connection element(s).

The/each second connection element may be configured to connect at least a part of the device, e.g. the first elongate member, first portion and/or first guide element, to the structure. The/each second connection element may be configured to co-operate and/or engage with the first/each connection element of the device.

The/each second connection element may comprise a slot or recess and/or an aperture for receiving, the first elongate member of the device and/or engaging or co-operating with each/the first connection element of the device. The/each second connecting element may be or comprise a plate member, e.g. a cheek plate or the like. The second connecting element may be arranged on the structure such that the second element protruded or extends from the structure.

A pair of second connection elements may be configured to connect at least one device to the structure.

The assembly may comprise a chain connecting portion. The chain connecting portion may be part of or comprised in the structure. The chain connecting portion may be or comprise a chain table. The chain connecting portion may be connected or connectable to the structure. For example, the chain connecting portion may be connected or connectable to the structure to allow rotational or pivotal movement of a chain connecting portion relative to the structure.

The assembly may comprise a chain or line. The chain or line may be or comprise a mooring, tethering and/or anchoring chain or line. At least a portion of the chain may be connected or connectable to the structure and/or a chain connecting portion, e.g. by the device. At least another portion of the chain may be connected or connectable to a seabed.

According to a third aspect of the present invention there is provided a method for connecting a chain to a structure. The method may comprise providing and/or connecting a device to the structure. The device may comprise any of the features of the device according to the first and/or second aspect(s).

The method may comprise engaging the chain with the device.

The method may comprise connecting a work wire or line to an end portion of the chain.

The method may comprise running, threading and/or passing the work wire or line into and/or through the device. This may engage the chain with the device. The step of running, threading and/or passing the work wire or line into and/or through the device may comprise running, threading and/or passing a chain into and/or through the device.

The method may comprise engaging the chain engaging arrangement with a chain to prevent movement of a chain in the second direction. The step of engaging the chain engaging arrangement with a chain may comprise operating, switching and/or actuating the chain engaging arrangement from the disengaged or non-engaging configuration to the engaged configuration of the chain engaging arrangement.

According to a fourth aspect of the present invention there is provided a method for adjusting tension and/or a length of a chain.

The method may comprise connecting the chain to the structure, e.g. using the device according to the first and/or second aspects. The step of connecting the chain to the structure may comprise any of the features defined in the third aspect.

The method may comprise moving the chain, e.g. at least a portion of the chain, in the first direction, e.g. towards the structure, to adjust the tension and/or length of the chain. The step of moving the chain in the first direction may comprise applying tension to the chain, e.g. at least a portion of the chain. Applying tension to the chain may comprise pulling, e.g. pulling-in of the chain, and/or applying a force to the chain, e.g. at least a portion of the chain, e.g. by using a winch, motor or the like.

The method may comprise moving or allowing movement of the chain in the second direction, e.g. releasing or letting out of, a portion of the chain to adjust tension and/or length of the chain.

It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF DRAWINGS

These and other aspects of the present invention will now be described, by way of example only, with reference to the accompanying drawings, which are:

FIG. 4(*b*) a schematic view of the chain stopper of FIG. 4(*a*);

FIG. 4(*c*) a schematic view of the chain stopper of FIG. 2 including the second guide element;

FIG. 5(*b*) a perspective view of the proximal end of the second portion of FIG. 5(*a*);

FIG. 5 (*c*) a perspective view of the underside of the second portion of FIG. 2;

FIG. 5(*d*) a part-cutaway view of the underside of the second portion of FIG. 2;

FIG. 6(*b*) a side view of the chain stopper of FIG. 6(*a*);

FIG. 6(*c*) a perspective view of chain stopper of FIG. 2 disconnected from a structure;

FIG. 7(*b*) a plan view of the chain stopper of FIG. 7(*a*); and

FIG. 7(*c*) a perspective view of the chain stopper of FIG. 7(*a*) when viewed from a distal end of the chain stopper.

DETAILED DESCRIPTION OF DRAWINGS

Figure 1:
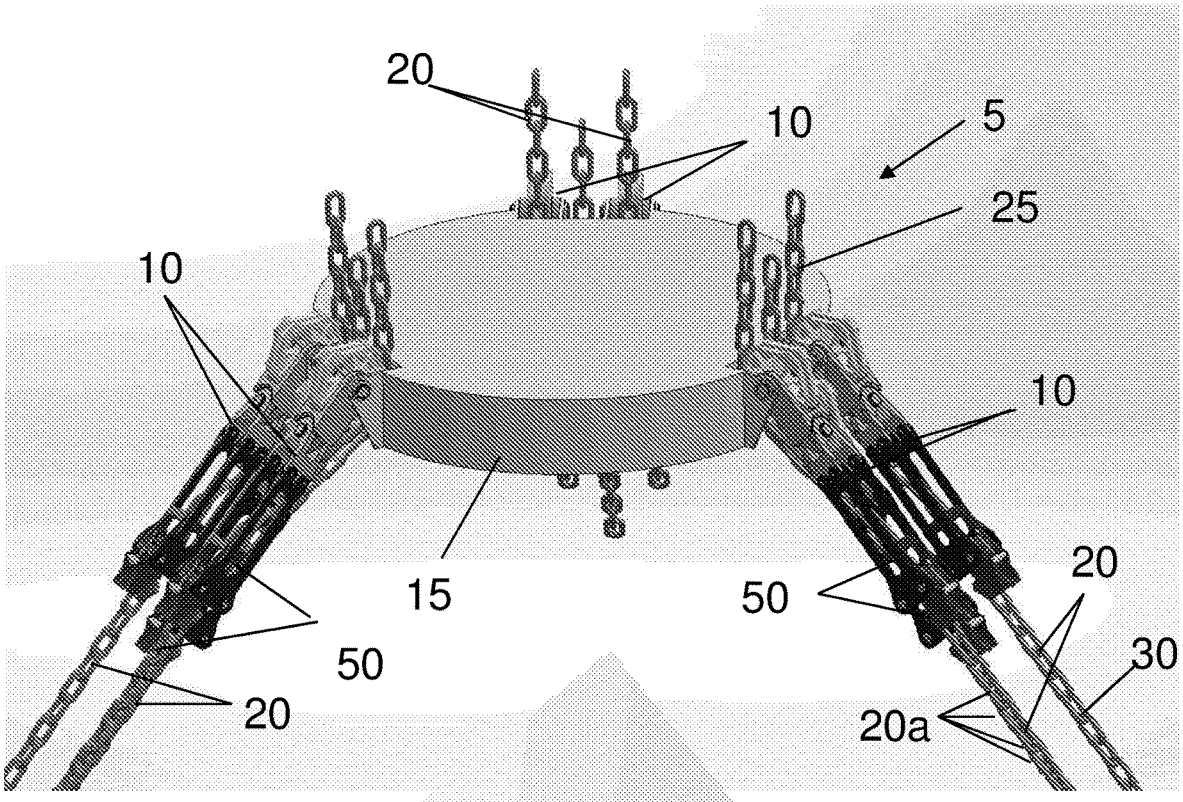
FIG. 1 an isometric view of an assembly including six chain stoppers according to one or more described examples.

FIG. 1 shows an example an assembly 5 including a device for connecting a chain to a structure. Here, the device is in the form of a chain stopper 10. It will be appreciated that in some examples the chain stopper 10 may include or be provided with a fairlead 11, while in other examples the chain stopper may be provided with other guiding means, e.g. a bending shoe or the like.

In the example of FIG. 1, six chain stoppers 10 are shown connected to a chain table 15. It will be appreciated that the assembly 10 may include more or less than six chain stoppers 10. The chain table 15 may be part of a structure (not shown), such as a vessel. The chain table 15 can be connected to the vessel to allow the rotational or pivotal movement of the chain table 15 relative to the vessel.

In the example shown in FIG. 1, each chain stopper 10 connects a chain 20, e.g. a proximal portion 25 of the chain 20, to the chain table 15. The chain 20 may be a mooring, tethering and/or anchoring chain. Another portion of the chain 20, e.g. a distal portion 30, is connected to the seabed (not shown).

Figure 2:
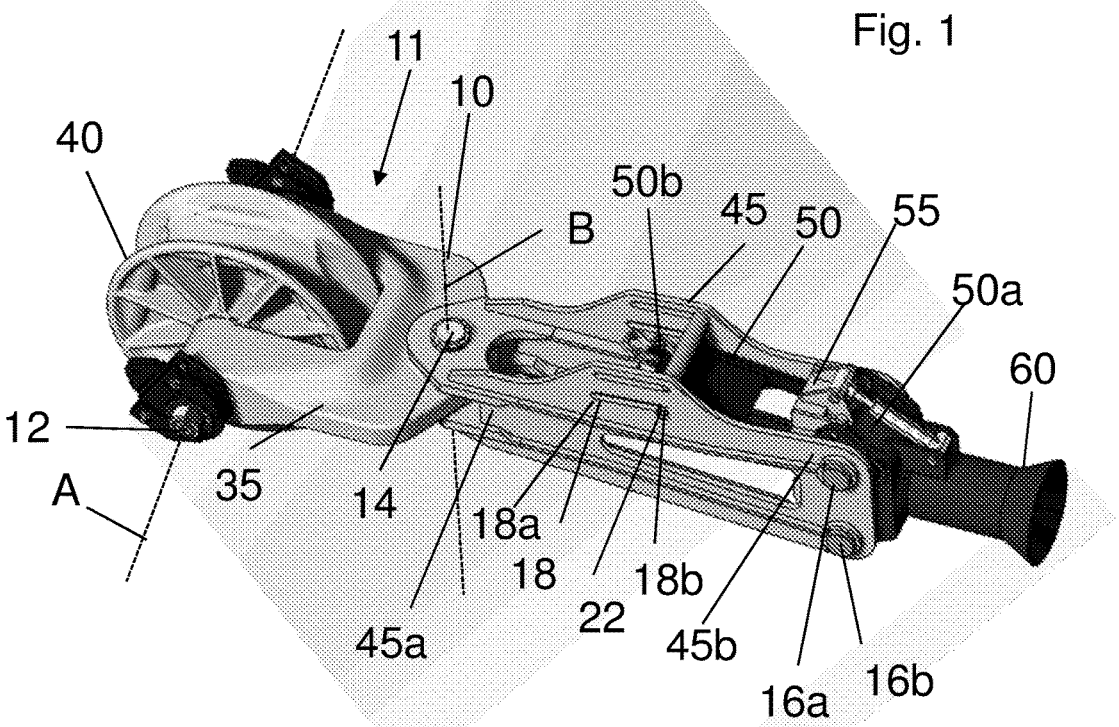
FIG. 2 an isometric view of a chain stopper according to one or more described examples.
Figure 3:
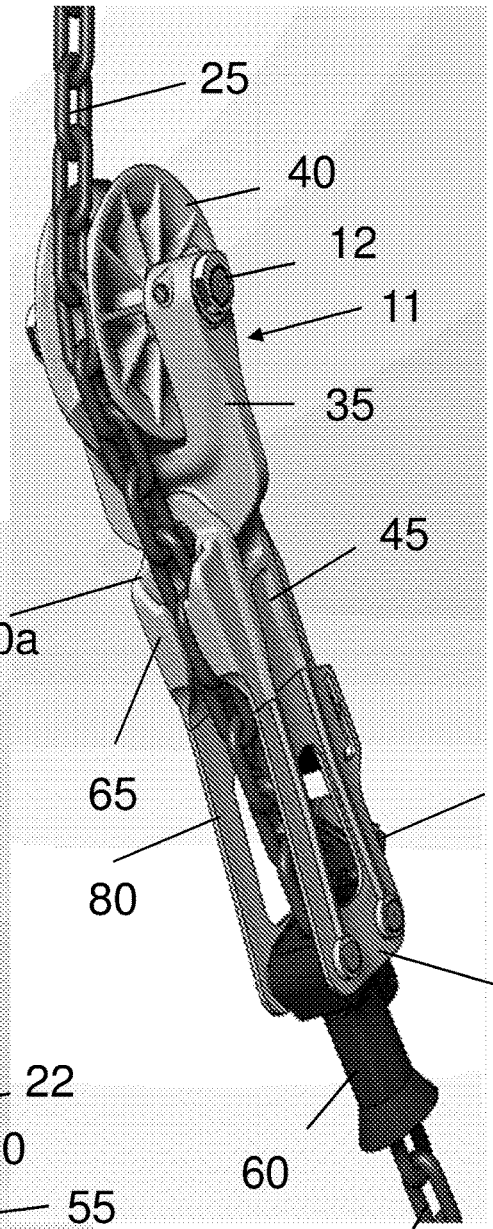
FIGS. 3(*a*) and 3(*b*) perspective views of the chain stopper of FIG. 2 including a chain.
Figure 3:
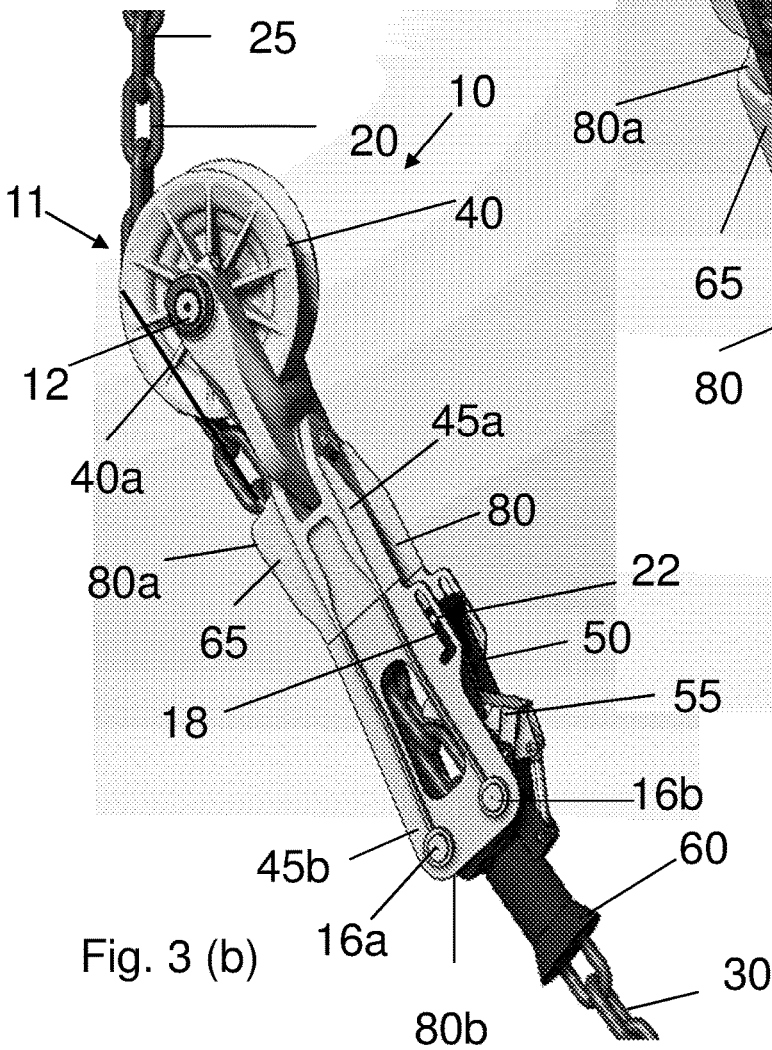

FIGS. 2 to 3(*b*) and 6(*a*) to 7(*c*) show an example of a chain stopper 10. The chain stopper 10 may be structurally similar and/or include any of the features of the chain stopper described in WO 2015/150770 (in the name of the present Applicant), which is hereby incorporated by reference.

Figure 6:
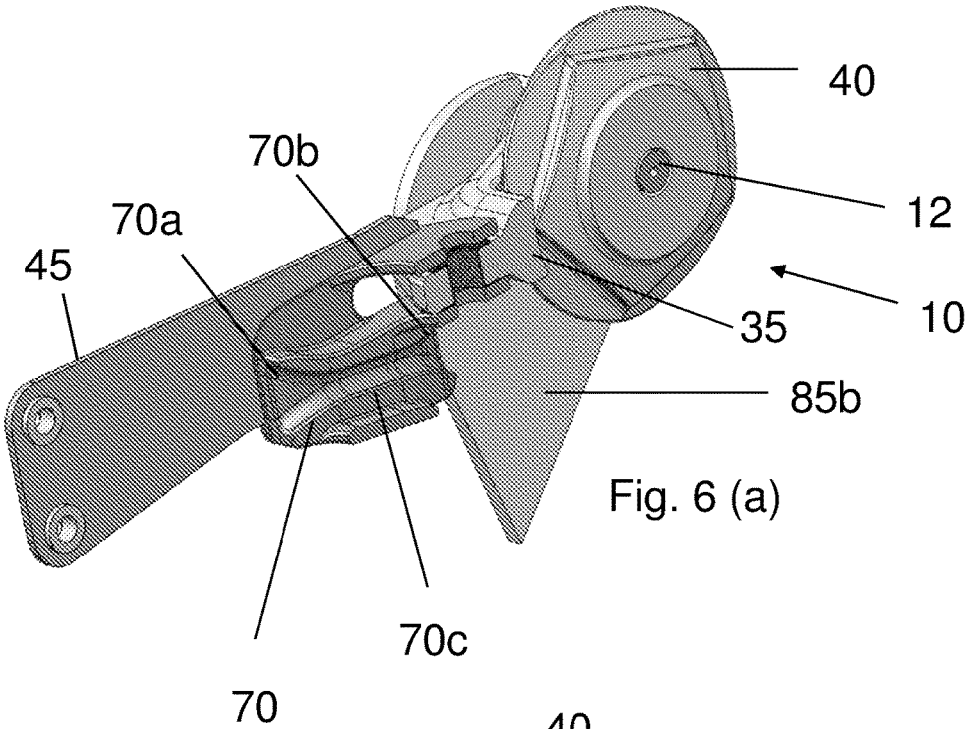
FIG. 6(*a*) a sectional view of the chain stopper of FIG. 2 connected to parts of a structure.
Figure 6:
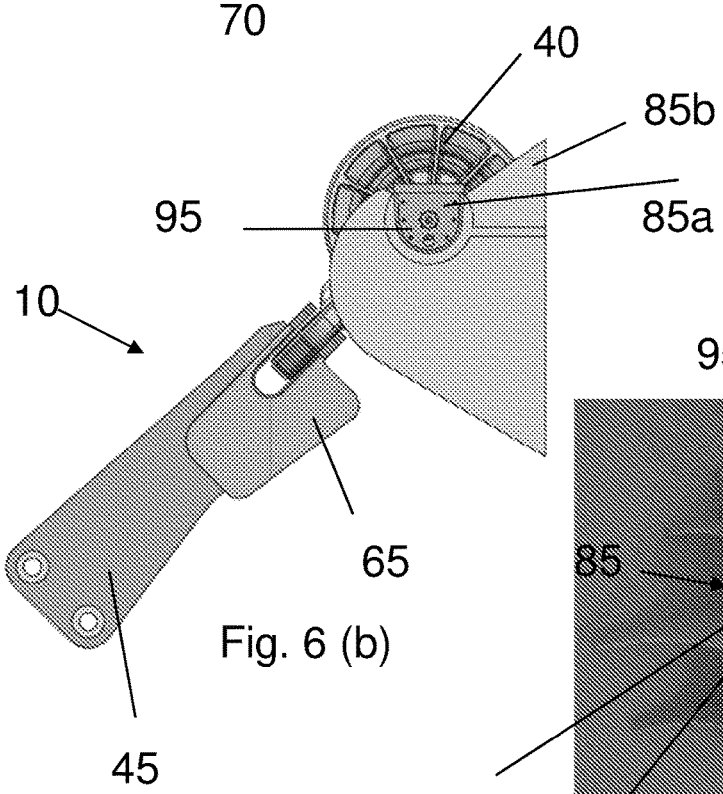
Figure 6C:
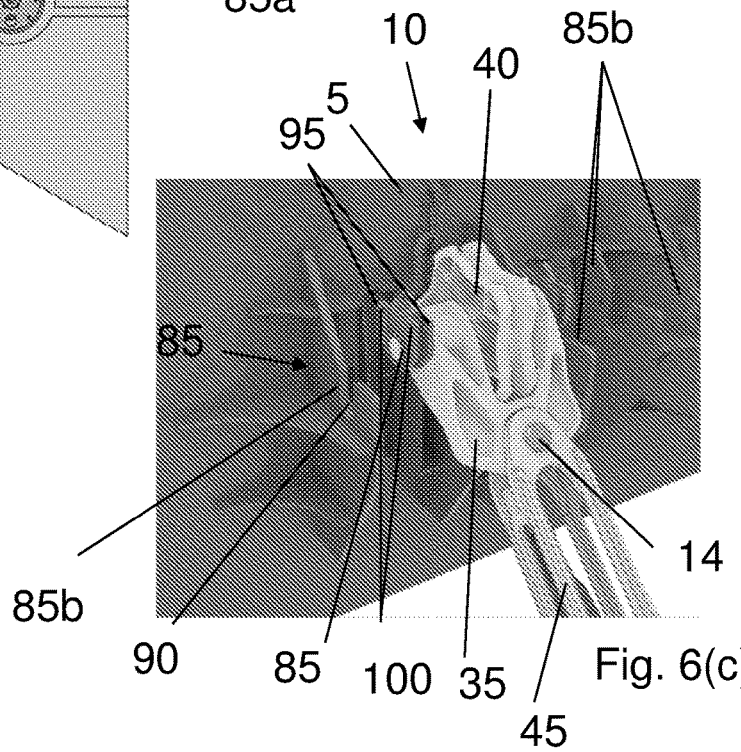

The examples of FIGS. 2 and 6(*a*) to 7(*c*) show the chain stopper 10 without the chain 20 being run through the device. FIGS. 3(*a*) and 3(*b*) show examples of the chain stopper 10 in use with the chain 20.

As shown in FIGS. 2 to 3(*b*) and 6(*a*) to 7(*c*), the chain stopper 10 includes a first portion 35, which has a first axis A. The first axis A defines a transverse and/or rotational axis of the first portion 35. Here, the first portion is configured to connect to the chain table 15 so as to be movable, such as pivotal or rotatable around the first axis, relative to the chain table 15. The first portion 35 may define at least part of the fairlead 11.

The chain stopper 10 includes a first elongate member, which may be in the form of a first pin or bolt 12, for connecting the chain stopper 10 to the chain table 15. The first pin or bolt 12 defines the first axis A.

The chain stopper 10 includes a first guide element 40. The first guide element 40 may define at least another part of the fairlead 11. For example, the first guide element 40 may be provided in the form of a guide wheel, fairlead wheel, sheave, pulley wheel, cog wheel or the like. Here, the guide wheel 40 is arranged relative to the first portion 35 so as to be movable, such as rotatable or pivotable, about the first axis A of the first portion 35. For example, the guide wheel 40 and the first portion 35 may be coaxially arranged. The guide wheel 40 guides a portion of the chain 20 around the first axis A. By arranging the guide wheel 40 to be movable around the first axis A of the first portion 35, tensioning or pulling-in of the chain 20 may be facilitated and/or loads and moments acting on the chain stopper 10 during tensioning or pulling-in of the chain 20 may be reduced.

The chain stopper 10 includes a second portion 45. Here, the second portion 45 is shown as being connected to the first portion 35. The second portion 45 is configured to connect to the first portion 35 so as to be movable, e.g. rotatable or pivotable, relative to the first portion 35. For example, the first and second portion 35, 45 may be connected together by a second elongate member, which may be in the form of a second pin or bolt 14. The second pin 14 may extend through apertures provided in the first and second portions 35, 45 to connect the first and second portions 35, 45. The second portion 45 has a second axis B, which defines a transverse and/or rotational axis of the second portion 45. The second pin or bolt 14 defines the second axis B.

The second portion 45 is connected to the first portion 35 so to be movable, e.g. rotatable or pivotable, relative to the first portion 35 about the second axis B. The first and second axes A, B are arranged relative to each other to be substantially perpendicular, when the first and second portions 35, 45 are connected to together, as shown in the example of FIG. 2.

The chain stopper 10 includes a chain engaging arrangement 50, which in this example is connected to the second portion 45 so as to be movable relative to the second portion 45. For example, the chain engaging arrangement 50 can be arranged on a distal end portion 45*a* of the second portion to be slideable and pivotal relative to the second portion 45, as for example, shown in FIGS. 2, 3(*a*) and 3(*b*). For example, an end portion 50*a* of chain engaging arrangement 50 can be pivotably connected to the distal end portion 45*a* of the second portion by a pair of third elongate member 16*a*, 16*b*, which may be in the form of a pair of pin or bolts 16*a*, 16*b*. It will be appreciated that in other example more or less than two third elongate members may be used to connect the chain engaging arrangement 50 to the second portion 45. In this example, another end portion 50*b* of the chain engaging arrangement 50 is slidable connected to the second portion 45. The second portion 45 includes a channel or slot 18 in which a fourth elongate member, which may be in the form of a fourth pin or bolt 22, is slidably arranged.

The chain engaging arrangement 50 may be operable between a first configuration and a second configuration. In use, when no tension is applied to the proximal portion 25 of the chain 20, the chain engaging arrangement 50 can be in the first configuration. In the first configuration, the fourth pin is located at or in proximity to a first end 18*a* of the channel 18.

When tension is applied to the proximal portion 25 of the chain 20 or the chain 20 is pulled towards the vessel, in use, the chain engaging arrangement 50 can move from the first configuration to the second configuration, e.g. by pivoting around third pins 16*a*, 16*b* and/or sliding the fourth pin 22 towards a second end 18*b* of the channel 18. The second end 18*b* of the channel 18 may include a notch or groove to retrain the fourth pin 22 at the second end 18*b* of the channel 18, e.g. when tension is applied to the proximal portion 25 of the chain 20. In the second configuration of the chain engaging arrangement 50, the chain engaging arrangement is configured to align the distal portion 30 of the chain 20 so as to be in line or coaxial with a central axis (not shown) of the chain stopper 10. By aligning the distal portion 30 of the chain 20 to be in line or coaxial with the central axis of the chain stopper 10, out of plane bending of the chain and/or chain stopper 10 and/or out of plane strain acting on the chain 20 and/or the chain stopper 10 may be reduced. Such coaxial arrangement of the distal portion 30 of the chain 20 with the chain stopper 10 may allow the use of higher forces during tensioning, e.g. pulling-in, of the chain 20.

The chain engaging arrangement 50 is configured to allow movement of the chain 20 in a first direction relative to the chain stopper 10. For example, movement of the chain 20 in the first direction may include movement of the chain towards a vessel. The chain engaging arrangement 50 is configured to inhibit movement of the chain 20 in a second direction. For example, movement of the chain 20 in the second direction may include movement of the chain 20 towards the seabed. The chain engaging arrangement 50 has an engaged and/or a disengaged or non-engaging configuration or position. In the engaged configuration, the chain engaging arrangement 50 inhibits movement of the chain 20 in the second direction, e.g. towards a seabed. For example, in the engaged configuration the chain engaging arrangement 50 may restrain, prevent and/or lock movement of the chain in the second direction relative to the chain stopper 10.

In the disengaged or non-engaging configuration, which is shown in FIGS. 3(*a*) and 3(*b*), the chain engaging arrangement 50 allows movement of the chain 20 in one or more directions. For example, in the disengaged or non-engaging configuration movement of the chain 20 is permitted in the first and/or second direction(s), e.g. towards the vessel and/or seabed. This may allow releasing of the chain 20, e.g. letting out of some of the chain 20, to adjust a length of the chain and/or tension.

The chain engaging arrangement 50 includes a stopper member 55 that is configured to engage the chain 20 in the engaged configuration and/or to prevent movement of the chain 20 in the second direction. In the example of FIG. 2, the stopper member 55 is shown in the engaged configuration whereas in the examples of FIGS. 3 (*a*) and 3 (*b*), the stopper member 55 is shown in the disengaged or non-engaging configuration. The chain engaging arrangement 50 is operable or switchable between the engaged and/or the disengaged or non-engaging configuration or position, for example, by applying tension to the chain 20. In other words, in use, when tension is applied to the proximal portion 25 of the chain 20, the chain engaging arrangement is operated from the engaged configuration, shown in FIG. 2, to the disengaged or non-engaging configuration, shown in FIGS. 3(*a*) and 3(*b*). This allows movement of the chain 20 towards the chain table 15 and/or the vessel. In use, when the tension acting on the proximal portion 25 of the chain 20 is reduced, e.g. after pulling-in of the chain 20, the chain engaging arrangement 50 moves into the engage position, thereby preventing movement of the chain 20 towards the seabed.

Alternatively or additionally, the chain engaging arrangement 50 may be operated from the engaged configuration to the disengaged configuration, for example, by external means, such as an Remotely Operated Vehicle, or other actuation means, such a cylinder and piston arrangement.

In some examples, the chain engaging arrangement 50 includes a guide element 60, which is configured to guide chain 20 into the chain engaging arrangement 50 and to align the chain 20 relative to the chain engaging arrangement 50. The guide element 60 is configured to co-operate with the chain 20. The guide element 60 has a cross-section and/or shape that substantially matches or corresponds to a cross-section and/or shape of the chain 20, as shown, for example, in FIG. 7(*c*). Here, the cross-section of the guide element 60 defines a substantially cruciform and/or clover leaf like shape. It will be appreciated in other examples the guide element 60 may have any other shape and/or cross-section that is suitable for guiding and/or aligning the chain 20.

The chain stopper 10 includes a second guide element 65, which in this example is arranged in proximity to the guide wheel 40, as shown in the example of FIG. 3(*b*). The second guide element 65 is configured to align the chain 20, e.g. at least a portion of the chain 20, relative to the guide wheel 40. By providing the chain stopper 10 with the second guide element 65, misalignment of the chain 20 relative to the guide wheel 40 and/or the chain table 15 may be reduced and/or prevented.

In this example, the second guide element 65 is arranged on the second portion 45. It will be appreciated that in other examples, the second guide element 65 may be arranged on the first portion 35 instead of being arranged on the second portion 45 or may be arranged on the first portion 35 in addition to being arranged on the second portion 45. For example, the second guide element 65 may include a first guide portion and a second guide portion (not shown). The first guide portion may be arranged on the first portion 45 of the chain stopper 10 and the second guide portion may be arranged on the second portion 45 of the chain stopper 10. Here, the second guide element 65 is arranged on an underside of the second portion 45.

Figure 4:
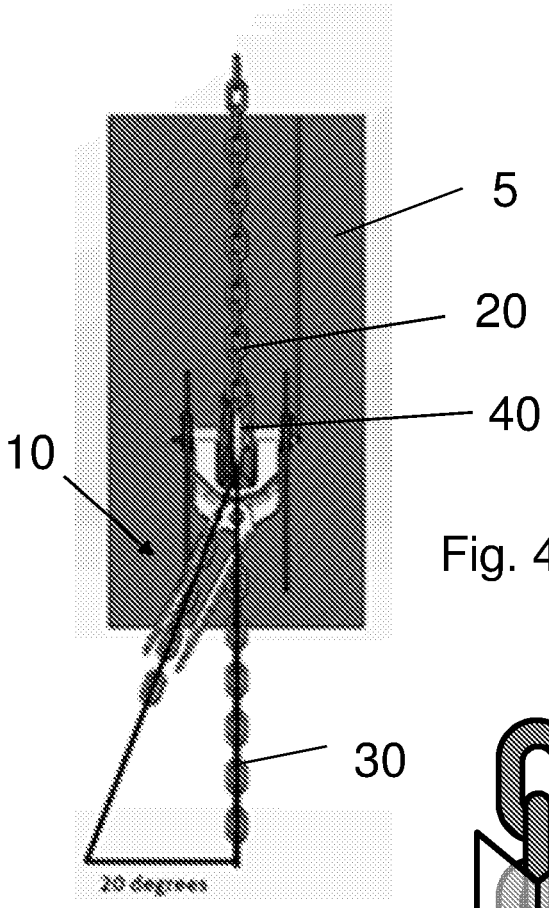
FIG. 4(*a*) a perspective view of a chain stopper without a second guide element connected to a structure and showing the extension of the chain relative to the chain stopper.
Figure 4B:
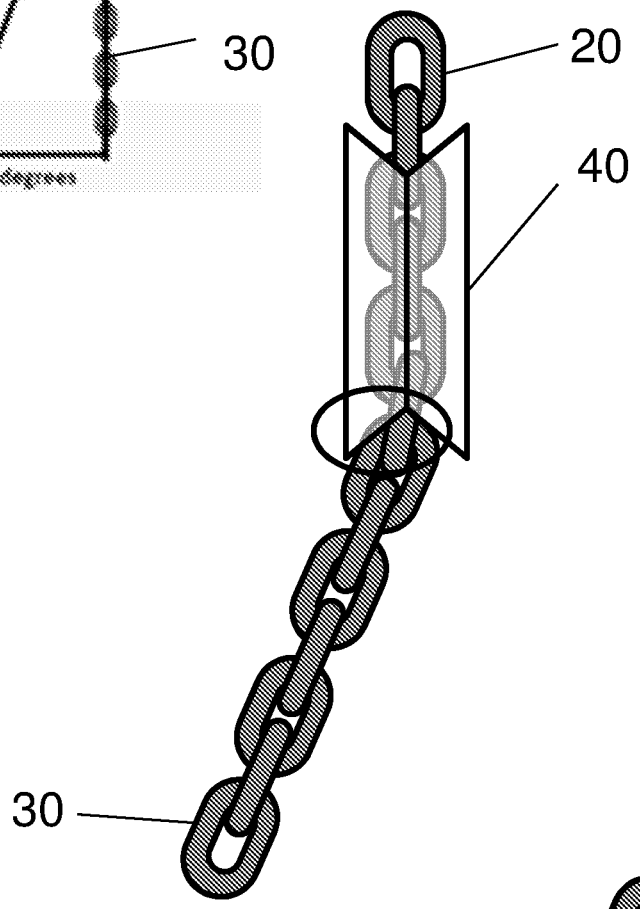
Figure 4:
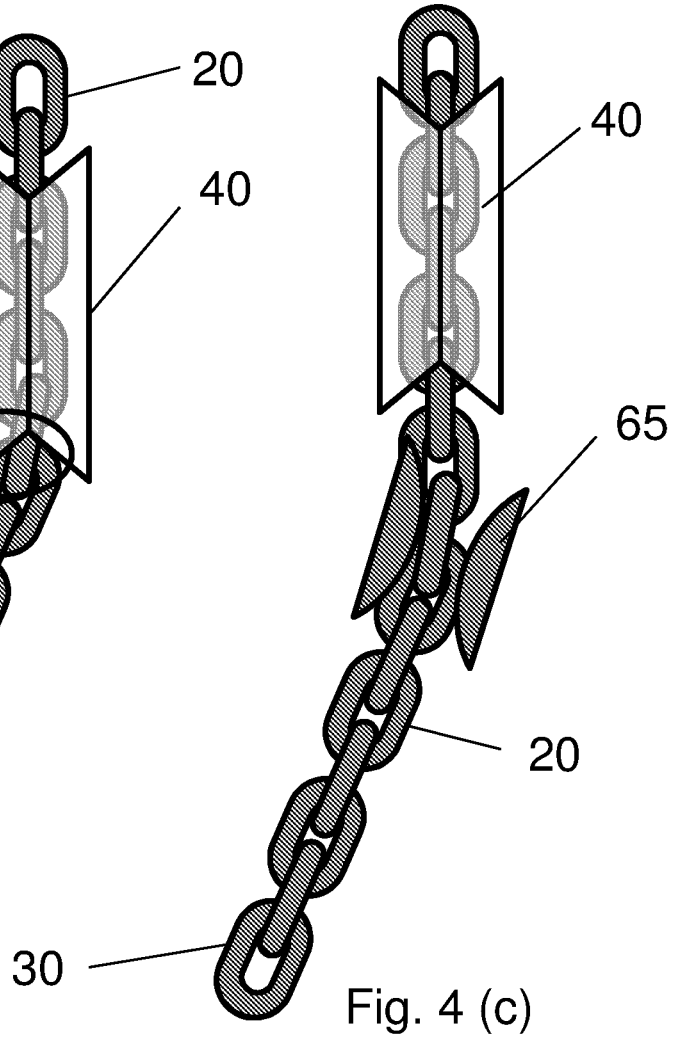

The example of FIG. 4(*a*) shows the chain stopper 10 attached to the chain table 15. In use, the distal portion 30 of the chain 20 may be moored to the seabed. Movement of the vessel can cause the second portion 45 and a portion of the chain 20 to extend at an angle, e.g. an azimuthal angle, relative to the guide wheel 40, as shown in the example of FIG. 4(*a*). When this angle becomes large, e.g. about 15 to 20 degrees, the chain 20 may become misaligned relative to at least the guide wheel 40, the first portion 35 and/or the chain table 15. An example of the misalignment between a portion of the chain 20 and the guide wheel 40 and/or the chain table 15 is shown in FIG. 4(*b*). It will be appreciated that in use, such misalignment of the chain 20 may lead to damage of the chain stopper 10 and/or the chain 20, for example, when tension is applied to the proximal part 25 of the chain 20.

FIG. 4(*c*) shows an example of chain stopper 10 including the second guide element 65. As can be seen in FIG. 4(*c*), the second guide element 65 is configured to guide and/or align the chain 20, e.g. at least a portion of the chain 20, relative to a central or longitudinal axis of the guide wheel 40. The second guide element 65 guides and/or aligns the chain 20, e.g. a portion of the chain 20, irrespectively and/or independently of the angle at which the chain 20 extends relative to the guide wheel 40. For example, the second guide element 65 is configured to move the chain 20 into axial alignment with the longitudinal axis of the guide wheel 40. In other words, the second guide element 65 is configured to guide the chain 20 such that a longitudinal axis of the chain 20 is substantially aligned or coincident with the longitudinal axis of the guide wheel 40.

As shown in the examples of FIGS. 3(*a*) and 3 (*b*), the second guide element 65 can be configured to substantially align the chain 20 with a tangential portion 40*a* of the guide wheel 40. In other words, the tangential portion 40*a* of the guide wheel 40 may be a portion and/or axis 40*a* that extends tangentially from the guide wheel 40.

It will be appreciated that the second guide element 65 can be configured to guide the chain 20 towards the guide wheel 40, in use. For example, the second guide 65 element is be configured to align at least a portion of the chain 20 relative to the guide wheel 40 prior to engagement of that portion of the chain 20 with the guide wheel 40 and to maintain the alignment of the chain 20 relative to guide wheel 40, in use.

Figure 5:
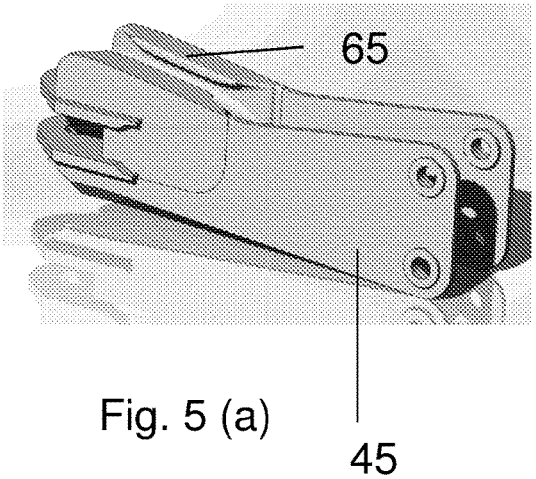
FIG. 5(*a*) a perspective view of the second portion of the chain stopper of FIG. 2.
Figure 5:
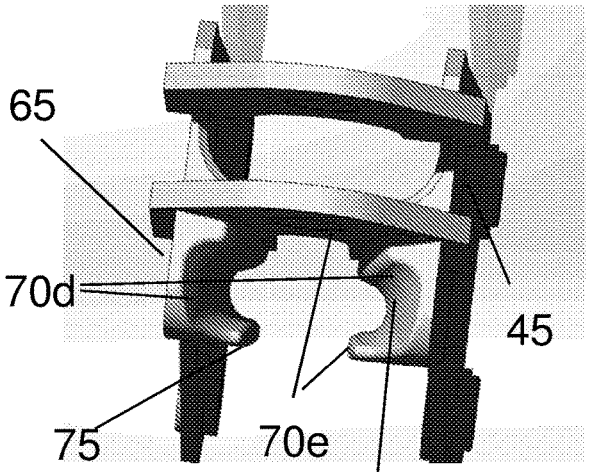
Figure 5:
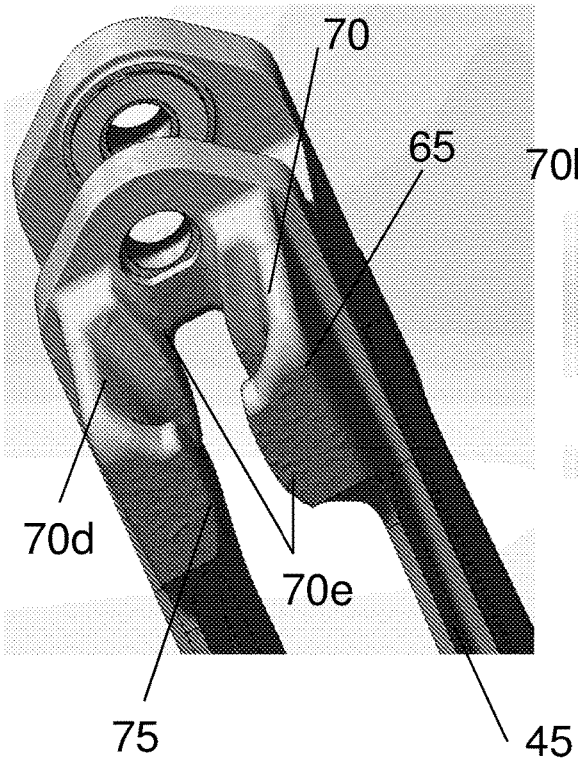
Figure 5:
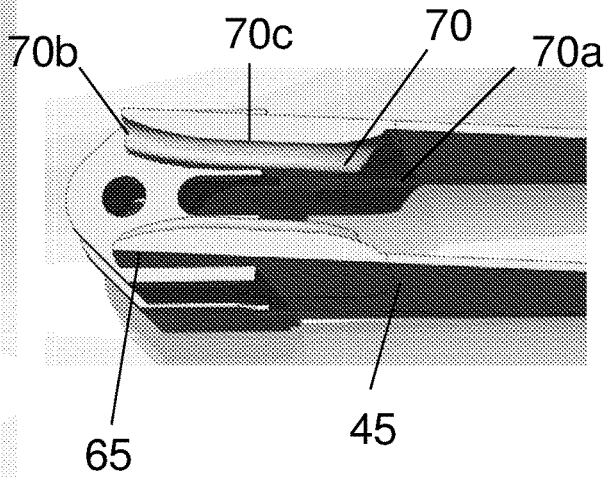

The shape or profile of the second guide element 65 is shown in FIGS. 5(*b*) to 6(*a*). The second guide element 65 has a shape or profile that is compatible and/or complementary with a shape of the chain 20, e.g. a cross-section of the chain 20. The chain 20 includes a plurality of chain links 20*a*, which alternately extend in a first direction and a second direction, whereby the first and second directions can be substantially perpendicular to each other. In other words, each chain link 20*a* has an orientation that differs from the orientation of preceding and subsequent chain links 20*a*, whereby the preceding and subsequent chain links 20*a* have substantially the same orientation. The second guide element 65 is configured to guide and/or align the chain 20, e.g. each chain link of the plurality of chain links.

As shown in the examples of FIGS. 5(*b*) to 6(*a*), the second guide element 65 includes a passage 70, through which the chain 20 is run, in use. The passage 70 is configured to co-operate with the chain 20 so as to align the chain 20 relative to the central axis of the guide wheel 40 and to guide the chain 20 towards the guide wheel 40. For example, the passage 70 defines a cross-section configured to substantially match or correspond to at least part of a cross-section of the chain 20. As shown in the example of FIG. 5(*a*), the cross-section of the passage 70 is similar to part of a cruciform, clover leaf shape or the like. It will be appreciated that the cross-section of the passage 70 may have or resemble other shapes, which complement or match a cross-section of the chain 20.

As shown in the example of FIG. 6(*a*), the passage 70 includes a first opening 70*a* and a second opening 70*b*, which are provided at either end of the passage 70. In the example of FIG. 6(*a*), the passage 70 is configured to taper from the first and second openings 70*a*, 70*b* of the passage towards an inner part 70*c* of the passage 70. By configuring the passage 70 to taper towards the inner part 70*c* of the passage 70, entry of the chain 20 into the second guide element 65, e.g. the passage 70, may be facilitated.

Referring to the examples shown in FIGS. 5(*a*) to 5(*c*), the passage 70 defines a first passage portion 70*d*, which may extend in a first direction of the second guide element 65, and a second passage portion 70*e*, which may extend in a second direction of the second guide element 65. In this example, the first and/or second directions are substantially perpendicular to the longitudinal axis of the second guide element 65. For example, chain links 20*a* that extend in the first directions may extend in a direction that is substantially parallel to the second portion 45, e.g. a width of the second portion 45, and chain links 20*a* that extend in the second direction may extend in a direction that is substantially perpendicular to the second portion 45, e.g. the width of the second portion 45. The first and second passage portions 70*d*, 70*e* are arranged relative to each other such that the first and second directions are substantially perpendicular to each another. The first passage portion 70*d* is configured to guide and/or align chain links 20*a* of the chain 20, which extend in the first direction, and the second passage portion 70*e* is configured to guide and/or align chain links 20*a* of the chain 20, which extend in the second direction.

In the examples shown in FIGS. 5(*a*) to 5(*c*), the second passage portion 70*e* has a slot or recess 75. The slot 75 is configured to guide and/or align chain links 20*a* of the chain 20, which extend in the second direction. Here, the slot 75 is arranged on the second guide element 65 to extend along or in a substantially longitudinal direction of the second guide element 65.

Referring to the examples shown in FIGS. 2 to 3(*b*) and 5(*a*) to 6(*a*), the second portion 45 defines a further passage 80 through which, in use, the chain 20 is run or threaded. The further passage 80 includes a first opening 80*a* and a second opening 80*b*. The first opening 80*a* of the further passage 80 is arranged on a first end portion 45*a* of the second portion 45, which is proximal to the first portion 35, e.g. when the second portion 45 is connected to the first portion 35. The second opening 80*b* of the further passage 80 is arranged on a second end region 45*b* of the second portion 45, which is distal to the first portion 35, e.g. when the second portion 45 is connected to the first portion 35. The first opening 80*a* of the further passage 80 is arranged to receive and/or provide an exit for the proximal portion 25 of the chain 20, in use. The second opening 80*b* of the further passage 80 is arranged to receive and/or provide an exit for the distal portion 30 of the chain 20.

In the examples shown in FIGS. 2 to 3(*b*) and 5(*a*) to 6(*a*), the second guide element 65 is arranged on the first end region 45*a* of the second portion 45, e.g. the first opening 80*a* of the further passage 80. By arranging the second guide element 65 at the first end region 45*a* of the second portion, the second guide element 65 may retain a portion of the chain 20 that may be slack, in use, e.g. when no tension is applied to the proximal portion 25 of the chain 20.

Figure 7:
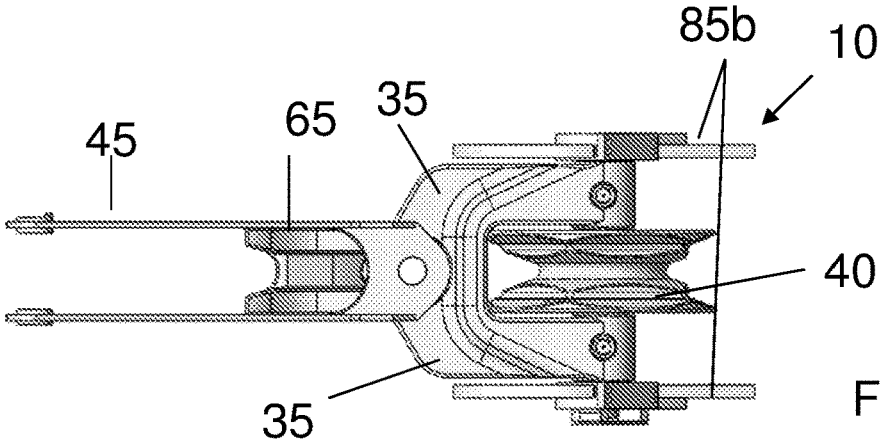
FIG. 7(*a*) a underneath view of the chain stopper of FIG. 2 connected to parts of a structure.
Figure 7:
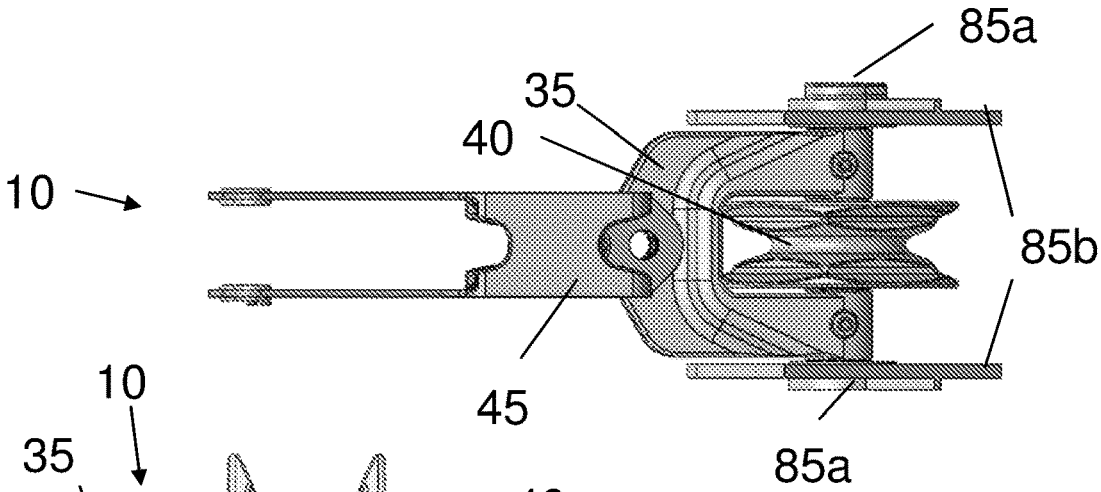
Figure 7:
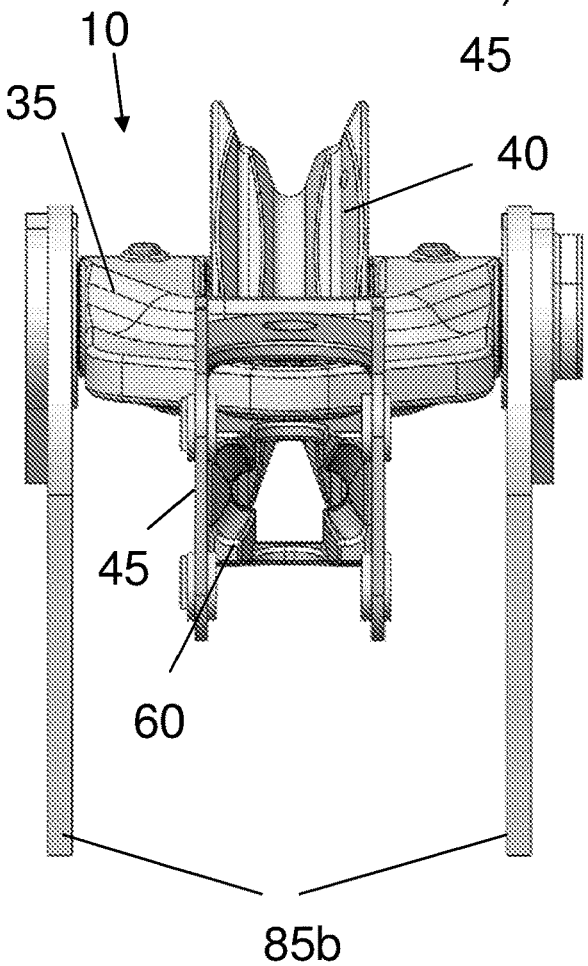

As shown in the examples of FIG. 6(*b*) to FIG. 7(*c*), the chain stopper 10 includes a first connection element 85*a* configured to connect the chain stopper 10 to the chain table 15 such that the chain stopper 10 movable, e.g. pivotal or rotatable, relative to the chain table 15 and/or the vessel. The first connection element 85*a* is configured to co-operate and/or engage with a second connection element 85*b* that may be provided on the chain table 15. The first and second connection elements may be part of a connection arrangement 85 for connecting the chain stopper 10 to the vessel.

The first connection element 85*a* is arranged on the first pin 12 of the chain stopper 10, as shown in the examples of FIGS. 6(*b*) and 6(*c*). The first connection element 85*a* can configured to secure, lock and/or fix the chain stopper to the chain table 15, for example, by connecting, e.g. releasably connecting, the first pin 12 of the chain stopper 10 to the chain table 15.

As shown in the example of FIG. 6(*c*), the chain stopper 10 includes a pair of first connection elements 85*a* for connection to a respective pair of second connection elements 85*b* of the chain table 15. Here, the first connection elements 85*a* of the chain stopper 10 are arranged on either side of the guide wheel 40. The second connection elements 85*b* may be in the form of plates for cheek plates, which may extend from the chain table 15.

There may be provided a plurality of second connection elements 85*b* on the chain table 15. Each second connection element 85*b* is configured to co-operate and/or engage with a respective first connection element 85*a* of the chain stopper 10. Here, the second connection element has a slot 90 for receiving the first pin 12 of the chain stopper 10. Here, each first connection element 85*a* includes a pair of substantially parallel plates 95 that are connected together by a pair of pins 100. It will be appreciated that in other examples more or less than two pins 100 may be used to connect the plates 95 together or that other means may be used ro couple the plates to each other. The pair of the plates 100 are arranged and/or spaced from each other so as to be able to receive at least part of the respective second connection element 85*b* in the space. This permit securing of the first connection element 85*a* to the second connection element 85*b*. The first and second connection elements 85*a*, 85*b* allow the chain stopper 10 to be releasably connected to the chain table 15. This facilitates installation, replacement and/or maintenance of the chain stopper 10.

In use, the chain 20 is connected to chain table 15 by connecting the chain stopper 10 to the chain table 15, for example, as described above. Subsequently, a chain 20 may be provided, for example by retrieving a chain 20 from the seabed or from the deck of the vessel. An end of a chain 20 may be connected to a work line or wire, which is threaded or run through a chain stopper 10, in use. By threading the work wire through a chain stopper, a chain 20 is brought into engagement with a chain stopper 10 and threaded or run into a chain stopper 10. In use, when a chain 20 has been run through a chain stopper 10, the chain engaging arrangement 50 may engage with the chain 20, as described above, to prevent movement of the chain 20 relative to the chain stopper 10, e.g. toward the seabed.

In use, the tension acting of the chain and/or a length of the chain may be adjusted using the chain stopper 10. This may include moving a portion of the chain 20 towards the vessel to adjust the tension and/or length of the chain 20. For example, a portion of the chain may be moved towards the vessel by applying a tension to the chain, e.g. pulling-in of the chain and/or applying a force to the chain, e.g. by using a winch, motor or the like. It will be appreciated that in other examples, other means for pulling-in of the chain may be used.

In use, tension acting on the chain 20 and/or a length of the chain 20 may be adjusted or changed by releasing some of the chain 20, e.g. letting some of the chain 20 move towards the seabed.

It should be understood that the embodiments described herein are merely exemplary and that various modifications may be made thereto without departing from the scope of the invention.

Although the device is described as the chain stopper above, it will be appreciated that in other examples, the device may be a connector or may be a so-called "fair lead" or provided in combination with a/the fairlead.

For example, the structure may be an offshore structure, marine structure, subsea structure, floating structure, floating platform, vessel or the like. One or more chain stopper(s) 10 may be connected the structure, e.g. directly connected to the structure, instead of or in addition to being connected to the chain table 15.

For example, a line, such as a wire, rope, synthetic line or the like, may be used instead of or in addition to a chain.

It will be appreciated that the chain stopper 10 may include more than one chain engaging arrangements.

Although the second guide element 65 has been described in the examples above as being arranged on the second portion 45, it will be appreciated that in other examples, the second guide element 65 may be provided on the first portion 35, e.g. on an end of the first portion proximal to the first guide element. Alternatively or additionally a part of the second guide element may be provided on the first portion 35 and a second part of the second guide element may be provided on the second portion 45.

In the examples described above, the first connection element 85*a* includes a pair of plates for connecting the first connection element 85*a* to the second connection element 85*b*. It will be appreciated that in other examples other connection means, such as a nut and/or bolt arrangement or a flange arrangement or the like may be used.

Although each/the second connection element 85*b* has been described above as including a slot or recess, it will be appreciated that in other examples, each/the second connection element may include an aperture for receiving and/or connecting the first axis of the chain stopper 10 to the chain table 15, as shown in the example of FIG. 1.

For example, the first guide element 40 may be or define guide elements suitable for guiding a chain, e.g. a bending shoe or the like.

The invention claimed is:

1. A device for connecting a chain or line, the device comprising:

a first portion comprising a first axis, the first portion being configured to connect or be connectable to a structure so as to be movable relative to the structure;

a first guide element, the first guide element being arranged on or relative to the first portion to be movable around or about the first axis of the first portion;

a second guide element, the second guide element being arranged in proximity to the first guide element and configured to align at least a portion of a chain relative to the first guide element; and a chain engaging arrangement comprising a third guide element.

2. The device according to claim 1, wherein the second guide element is selected from at least one of being:

arranged in proximity to the first guide element;

arranged on the first portion;

configured to guide and/or align at least a portion of a chain or line relative to a central or longitudinal axis of the first guide element;

configured to guide, move, or bring a chain or line into axial alignment with a/the longitudinal axis of the first guide element;

configured to substantially align a longitudinal axis of at least a portion of a chain or line with a tangential portion of the first guide element;

configured to guide at least a portion of a chain or line towards the first guide element;

configured to align at least a portion of a chain or line relative to the first guide element prior to engagement of that portion of a chain or line with the first guide element;

a shape, which is configured to be compatible and/or complementary with a shape of a chain.

3. The device according to claim 1, wherein the second guide element defines or comprises a passage, a chain or line being passable or threadable through the passage.

4. The device according to claim 3, wherein the passage is selected from at least one of being:

configured to co-operate or engage with a chain to align at least a portion of a chain or line relative to a/the central or longitudinal axis of the first guide element;

comprising or defining a cross section adapted or configured to substantially match or correspond to at least part of a cross-section of a chain;

comprising a first opening and/or a second opening, the first and second openings of the passage being provided at either end of the passage;

comprising or defining at least a first passage portion, which extends in a first direction of the second guide element, and a second passage portion, which extends in a second direction of the guide element.

5. The device according to claim 1, wherein the device comprises a second portion, the second portion being configured to connect or be connectable to the first portion so as to be movable relative to the first portion, and wherein the second guide element is arranged on the second portion.

6. The device according to claim 5, wherein the device comprises a further passage for receiving at least a portion of a chain or line, the further passage being part of the second portion.

7. The device according to claim 5, wherein the device comprises a second axis, the second axis being part of the second portion and being arranged to be substantially perpendicular to the first axis, when the first and second portions are connected to each other.

8. The device according to claim 5, wherein the chain engaging arrangement is connectable or connected to the second portion so as to be movable relative to the second portion, wherein the chain engaging arrangement is configured to allow movement of a chain relative to the device in a first direction and to inhibit movement of a chain relative to the device in a second direction.

9. The device according to claim 8, wherein the third guide element is configured to guide a chain to or into the chain engaging arrangement.

10. The device according to claim 1, wherein the device comprise a first connection element, the first connection element being configured to connect the device to a structure.

11. An assembly comprising a device for connecting a chain to a structure according to claim 1; and a structure.

12. The assembly according to claim 11, wherein the structure comprises an offshore structure, marine structure, subsea structure, floating structure, floating platform, buoy and/or vessel.

13. The assembly according to claim 11, wherein the assembly comprises:

a connection arrangement, the connection arrangement being configured to connect the device to the structure;

a chain connecting portion, the chain connecting portion being connected or connectable to the structure;

a chain or line, the chain or line being or comprising a mooring, tethering and/or anchoring chain or line.

14. A method for connecting a chain to a structure, the method comprising:

providing a device according to claim 1;

connecting the device to the structure.

15. The method according to claim 14, further comprising connecting a work wire or line to an end portion of the chain.

16. The method according to claim 14, further comprising running, threading and/or passing the work wire or line into and/or through the device.

17. A method for adjusting tension and/or a length of a chain, the method comprising:

connecting the chain to the structure using the device according to claim 1;

moving at least a portion of the chain in the first direction to adjust the tension and/or length of the chain.

18. The method according to claim 17, wherein the step of moving the chain in the first direction comprises applying tension to at least a portion of the chain.

19. The method according to claim 17, wherein the method comprises releasing or letting out of a portion of the chain to adjust tension and/or length of the chain.

* * * * *